United States Patent [19]

Turnwald et al.

[11] 4,273,028

[45] Jun. 16, 1981

[54] VALVES AND OPERATING SYSTEM FOR EXPANSION MACHINES

[75] Inventors: Ernst Turnwald, Altenmarkt; Stefan Asztalos; Rudolf Rosenmeier, both of Munich, all of Fed. Rep. of Germany

[73] Assignee: Linde Aktiengesellschaft, Wiesbaden, Fed. Rep. of Germany

[21] Appl. No.: 27,390

[22] Filed: Apr. 5, 1979

[30] Foreign Application Priority Data

Apr. 12, 1978 [DE] Fed. Rep. of Germany ..... 2815849

[51] Int. Cl.[3] ..... F01L 25/08

[52] U.S. Cl. ..... 91/275; 91/392

[58] Field of Search ..... 91/275, 392, 410, 404

[56] References Cited

U.S. PATENT DOCUMENTS

| | | | |
|---|---|---|---|
| 1,617,516 | 2/1927 | Farquhar | 91/275 |
| 2,604,079 | 7/1952 | Ray | 91/275 |
| 3,090,362 | 5/1963 | Rolls | 91/275 |

FOREIGN PATENT DOCUMENTS

| | | |
|---|---|---|
| 6943888 | 7/1970 | Fed. Rep. of Germany . |
| 2036379 | 2/1972 | Fed. Rep. of Germany . |
| 2205027 | 2/1972 | Fed. Rep. of Germany . |
| 1451955 | 6/1972 | Fed. Rep. of Germany . |
| 2231851 | 6/1972 | Fed. Rep. of Germany . |

*Primary Examiner*—Paul E. Maslousky
*Attorney, Agent, or Firm*—Karl F. Ross

[57] ABSTRACT

A valve for controlling the admission of gas to a cylinder of a piston-type machine, or for the discharge of gas therefrom, comprises a magnetic armature shiftable between a pair of magnetic poles formed to receive the armature with minimal radial play and with a predetermined air gap from the attracting pole in the energized condition of the coil. The energizing circuit includes an inductive proximity switch which is triggered without engagement by a metal formation on the crankshaft and applies its signal to a pulse former generating a steep-flank pulse triggering a timer to produce two rectangular voltage pulses of different durations. These pulses are applied to a gating circuit which produces a stepped signal with a high initial amplitude which is amplified and applied to a power converter energizing the coil with a corresponding current waveform. A monitoring circuit responds to deenergizing the coil to drain residual magnetism from the pole piece to enable a spring to rapidly close the valve.

8 Claims, 5 Drawing Figures

VALVES AND OPERATING SYSTEM FOR EXPANSION MACHINES

FIELD OF THE INVENTION

Our present invention relates to a valve construction and operating circuitry or timing circuitry for piston-type machines and, more particularly, to machines designed for the work expansion of low-temperature gases.

BACKGROUND OF THE INVENTION

In a variety of low-temperature gas processes, e.g. air rectification by the LINDE-FRÄNKL process and, more generally, in the separation of gases by pressurization and liquefaction, or in the liquefaction of low-boiling gases, such as helium, it is frequently necessary to expand high-pressure gases to lower pressures or to compress low-pressure gases to higher pressures.

Expansion for instance can be carried out, as described in chapter 12, pages 29 ff. of Perry's *Chemical Engineer's Handbook,* McGraw-Hill Book Company, New York, 1963, in turbine-type machines or piston-type machines, the invention being concerned with machines of the latter type. The work expansion of a gas is usually carried out against a load which can be, for example, a generator of electrical energy.

It is known to provide electromagnetically controlled valves for the cylinders of such low-temperature expansion machines to admit the high-pressure gas and to discharge the low-pressure gas, and to time the operation of the valve by cam-operated switches which are mechanically opened and closed by cams carried by the crankshaft of the machine.

More specifically, from German Pat. No. 1,217,982, for example, it is known to provide a valve control system for the gas cycling of the cylinder of a piston-type expansion machine by electromagnetically actuated inlet and outlet valves.

Each of these valves has a magnetic armature which cooperates with an electromagnetic coil so that, upon energization, the force of a spring biasing the valve member into a closing position can be overcome and the respective valve opened.

The circuit used in this prior-art system comprises a pair of mechanically operated switches connected in series with a current supply source.

The valve itself is a substantially axially symmetrical structure with respect to the axis of the magnetic coil and uses an armature of disk or plate shape which is disposed on one side of the coil and can simultaneously form the valve plate.

The coil is enclosed in a field-determining yoke or stator which is composed of iron and which, upon magnetic deenergization, forms a comparatively wide air gap which can intercept or provide a significant obstruction to the magnetic field lines upon reenergization of the coil.

When the coil is not energized and the valve is held closed by the spring, the large magnetic resistance resulting primarily from this air gap mandates a high energization current to attract the armature by overcoming the magnetic resistance as well as the spring force.

In the open condition of the valve, the air gap is practically eliminated and, because of the magnetic remanence of the yoke, remains attracted even after the current supply of the coil is cut off so that valve closing is delayed.

The energizing circuit for the prior-art system comprises the current source connected in parallel to a condenser and to the coil, the switches being provided in one of the connections between the condenser and the coil while an ohmic resistor is provided in the other connection.

When the switch contacts are opened, the condenser is charged through a charging resistor and, upon closure of the switches by the cams, the capacitor discharges through the coil to supplement the current drawn from the source and therefore provide the high initial current surge required to overcome the magnetic resistance, the spring force and the inertia of the valve plate.

While the system of the German patent has been found to be a vast improvement over valve systems which are mechanically linked to the crankshaft, it has some significant disadvantages. For instance, the high magnetic resistance prevents high-speed opening of the valve while the magnetic remanence prevents high-speed closing.

Wear of the mechanical switch system requires frequent replacement thereof and leads eventually to timing problems.

Low-temperature piston machines for the purposes described should also have relatively small heat capacities and thus should also have small dimensions and be capable of operating at high frequencies, a requirement which cannot be adequately fulfilled by the earlier systems.

OBJECTS OF THE INVENTION

It is the principal object of the present invention to provide an improved valve construction for a piston machine which is free from the disadvantages enumerated above, which can be rapidly opened and closed, and which can be operated with greater precision in timing than has hitherto been possible.

Another object of this invention is to provide an improved valve-operating system which enables more accurate timing of the opening and closing of a gas valve communicating with an expansion cylinder of a piston-type expansion machine, thereby enabling small machines with low heat capacity to be operated effectively at high cycling frequencies.

Still another object of the invention is to provide an improved work-expansion machine of the piston type for low-temperature applications whereby the disadvantages of earlier systems are avoided.

SUMMARY OF THE INVENTION

These objects and others which will become apparent hereinafter are attained, in a valve control system for the cylinder of a piston-type work expansion machine, especially for low temperature gases, in which the valves are opened electromagnetically, by the following combination:

(a) The valve-opening pulses are generated in synchronism with the piston movement by producing a triggering pulse for an electronic circuit with an inductive porximity switch which does not mechanically contact any cam or other part of the rotating system.

(b) The circuit which responds to the inductive proximity switch comprises:

(b1) an input stage or pulse former for generating, in response to actuation of the inductive switch, a steep flank voltage pulse, (b2) a timing or timer stage connected to the input stage or pulse former and responsive to the steep-flank pulse therefrom to produce two pulses of different but adjustable duration, (b3) a gating stage to transform the pulses from the timing stage into two substantially adjacent reactangular pulses of higher and lower amplitude together representing a stepped voltage pulse, (b4) an amplifier stage receiving the stepped pulse from the gating stage and amplifying same, (b5) a power converter stage for transforming the amplified stepped-voltage pulse into a corresponding current pulse for energizing the electromagnetic coil of the valve, and (b6) an intercept or monitoring stage responsive to the termination of the energization of the coil for magnetically draining same to promote fast switching and prevent excessive voltage spikes.

(c) The armature of the valve is positioned between poles or pole flanges of the magnetic stator or the pole piece and is a cylindrical body which can extend into axial recesses formed in these poles with minimal radial play, the depth of the recess out of which the core of armature moves upon energization of the magnet being deeper than the other recess while the floor of this other recess is provided with nonmagnetic spacers which retain the end of the armature out of engagement with this floor and prevent it from bottoming in this recess upon energization of the coil.

According to a feature of the invention, the inductive proximity switch cooperates with a metal cam-like member carried by the crankshaft of the machine.

Input stages can comprise, in succession, a threshold switch in the form of an operational-amplifier circuit which is followed by two Schmitt-trigger stages.

The timer stage advantageously comprises two monostable multivibrators, each with an externally-adjustable trimmer resistance for controlling the duration of the respective pulses produced therein.

According to the invention, moreover, the gating stage, which is designed to produce two directly following rectangular pulses of high and low voltage level, respectively, comprises a pair of analog switches whose outputs are connected, both of which have voltage sources of adjustable level. One of the analog switches being energized during the short pulse duration form a corresponding monostable multivibrator whose output, and the output of another monostable multivibrator, are applied through a gating logic (NOR-gates) to the other analog switch.

The intercept or monitoring stage for promoting decay of the magnetic energy, comprises a reverse-poled diode connected to the current path of the coil and a capacitor connected between this diode and the source. The voltage detector corresponding to the diode includes a Zener diode circuit operating a group of transistors connected in cascade.

The system of the present invention thus provides both an optimum valve structure and operating circuit which allows valve triggering at specially high rates. For instance, the valve can be fully opened upon coil energization in 7 to 10 msec. While, upon deenergization, the valve is fully closed in 10 to 12 msec. The system has been found to operate effectively in these ranges over long periods reliably without adjustment, and maintenance costs for wear of the switch are eliminated.

The use of pole pieces with shallow and deep recesses, respectively, which can be formed by sleeve-shaped cylindrical projections or bosses, and a generally cylindrical armature which is received with only slight radial play in these recesses, has been found to provide a significant advantage over the earlier systems as described by minimizing the magnetic resistance. While a relatively large axial space can form between the bottom of the deep-recess pole and the armature when the magnet is energized, this does not increase the magnetic resistance because the armature continues to be received in the cylindrical recess and to be surrounded by the wall thereof forming part of this magnetic pole. Consequently, the magnetic resistance between this pole and the armature is essentially independent of the position of the armature.

Because of the shallow nature of the recess of the opposite pole, however, the magnetic resistance between the armature and that pole is determined practically entirely by the axial air gap, the whole magnetic resistance of the system being dependent almost exclusively on this last-mentioned air gap. This has been found to increase the magnetic attraction speed and displacement rate of the armature.

An important element of the present invention is the use of the nonmagnetic spacer elements between the bottom of the recess of this other pole and the armature to ensure that an air gap will be maintained even in the attracted position of the armature thereby reducing the delay in returning the valve member in the opposite direction by the spring. This feature is coupled with the use of a stepped current pulse in the manner described so that, on the one hand, an adhesion of the armature of this other pole by magnetic remanence is avoided and yet the low-amplitude portion of the stepped current waveforms is sufficient to retain the armature against the spacer. This low-amplitude current decays more rapidly than a higher current would upon deenergization of the coil, again contributing to the speed with which the valve closes.

The other features of the invention alluded to earlier also have been found to be highly advantageous. For example, the use of an inductive proximity switch which cooperates with a formation carried by the crankshaft results in a periodic change in the leakage field to operate the switch and produce the initial voltage pulse.

SPECIFIC DESCRIPTION

Figure 1:
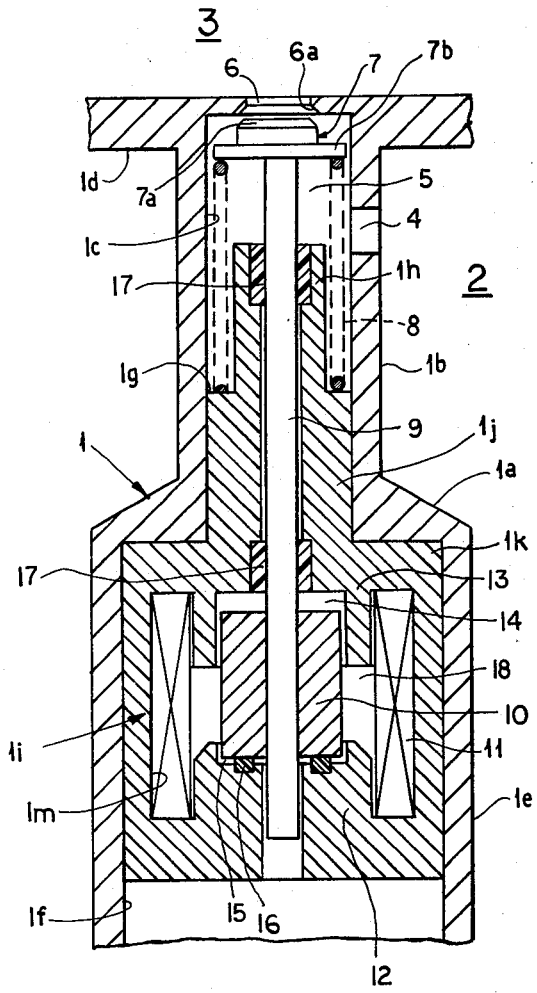
FIG. 1 is an axial cross-sectional view through the improved valve of the present invention.

FIG. 1 shows a valve for a piston-type expansion machine operating with gases at low temperature, e.g. cryogenic temperatures, and of the type described in German Pat. No. 1,217,982 referred to earlier.

This valve is represented at 1 and connects or blocks passage between two gas spacers or chambers of the machine represented at 2 and 3 respectively. The connection between the two is formed by a gas inlet 4, the interior 5 of the valve 1 and the outlet 6. More particularly, the valve 1 is formed with a valve body 1*a* having narrow cylindrical portion 1*b* traversed laterally by the inlet port 5 and formed with an axially extending small-diameter bore 1*c* defining the chamber 5 and extending perpendicularly to a wall 1*d* of the chamber 3 traversed by the bore 6 which is formed with a frustoconical seat 6*a* complementary to and snugly receiving the beveled portion 7*a* of a valve plate 7. The bore 6 is disposed along the axis of the chamber 5.

The housing 1*a* has a large-diameter cylindrical portion 1*e* formed with a large-diameter bore 1*f*.

The valve plate 7 is carried at the end of a valve stem or spindle 9 extending axially through the valve and is urged by a spring 8 to its closing position.

The compression spring 8 bears at one end against a disk 7*b* forming part of the valve plate 7 and is seated against a shoulder 1*g* around a cylindrical boss 1*h* of a body 1*i* fitted into the housing 1*a* and formed unitarily of magnetically permeable material.

At this shoulder 1*g*, the boss 1*h* extends into a cylindrical neck 1*j* which fits snugly in the bore 1*c* and adjoins a large-diameter portion 1*k* fitting snugly into the bore 1*f* and formed with magnetic bore pieces and a coil-receiving recess as will be described below.

At the opposite end of the valve stem 9, remote from the valve plate 7, there is mounted a magnetic core or armature 10 which is axially displaceable with spindle 9 for opening the valve against the force of spring 8.

The armature 10 is surrounded by a magnetic (solenoid) coil 11 received in a chamber 1*m* of the body 1*i* and energizable to generate a magnetic field whose lines of flux close through the armature 10 between cylindrical magnetic pole pieces or flanges 12 and 13 formed on the body 1*i*.

Both pole flanges 12 and 13 are formed with cylindrical axially open recesses 15 and 14, respectively, in which the armature 10 is received with only slight radial play for axial movement.

Spacer elements 16 of non-magnetic and non-magnetizable material are provided at the bottom of recess 15 to ensure a predetermined minimum axial spacing between the pole piece 12 and the armature 10 in the form of an axial air gap.

The valve stem 9 is guided in the dry-running slide bearings 17 adjacent to the pole flange 13 and in the boss 1*h*, respectively, to ensure precise guidance of the armature in the recesses 14, 15 and precise positioning of the valve plate 7 in the valve seat.

The relatively large axial depth of the recess 14 into which the armature 10 is urged by the spring 8 ensures that the magnetic resistance of the radial air gap between the armature 10 and the cylindrical inner wall of recess 14 will be independent of the position of the armature and because of small width of this air gap, the magnetic resistance thereof will be relatively small.

In the illustrated position of the armature 10, corresponding to opening of the port 6 and energization of the coil 11, and total magnetic resistance of the field generated by this coil has its minimum value.

When the coil 11 is deenergized, the spring 8 biases the valve plate 7 upwardly to close the valve and carry the armature 10 further into the recess 14.

In this position, the total magnetic resistance to the field, when it is again applied, is at a maximum and is determined largely by the magnetic resistance of the increased axial air gap between the armature 10 and the floor of the recess 15.

The valve-opening force is applied mainly via this axial air gap while the axial air gap on the opposite side has no influence because of the relatively large axial extension of the recess 74.

The spacer elements 16, which are preferably in the form of concentric rings, are preferably composed of polytetrafluoroethylene (Teflon), a material which is practically unaffected by temperature, has good wear resistance and minimizes noise upon impact of the armature 10 therewith.

Figure 2:
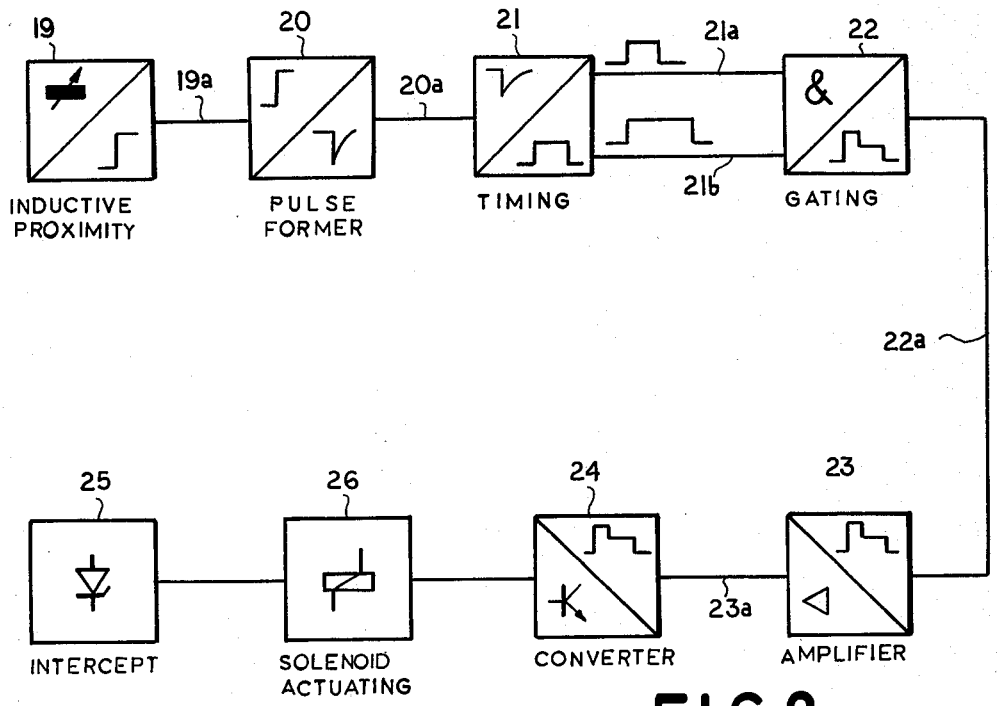
FIG. 2 is a block circuit diagram of the mainstages of the system for actuating the valve.

In FIG. 2 we have shown in block-diagram form the control system of the present invention for the solenoid or coil of the valve of FIG. 1.

This system or circuit, which will be described in greater detail hereinafter, comprises an inductive proximity switch 19, the output of which is applied at 19*a* to the input side of an input or pulse-forming stage 20 which has its output 20*a* connected to the input of a timing stage 21 having two outputs 21*a* and 21*b* which deliver respective simultaneously triggered rectangular timing pulses of different duration to the gating and pulse-forming stage 22 whose stepped output is applied at 22*a* to the amplifier stage 23. The output of amplifier stage 23 is applied at 23*a* to a switching or power-converter stage 24 in which the voltage pulses from the amplifier stage are converted into current pulses applied to the valve coil or solenoid stage represented at 26. Further shown is an interceptor stage 25.

Figure 3:
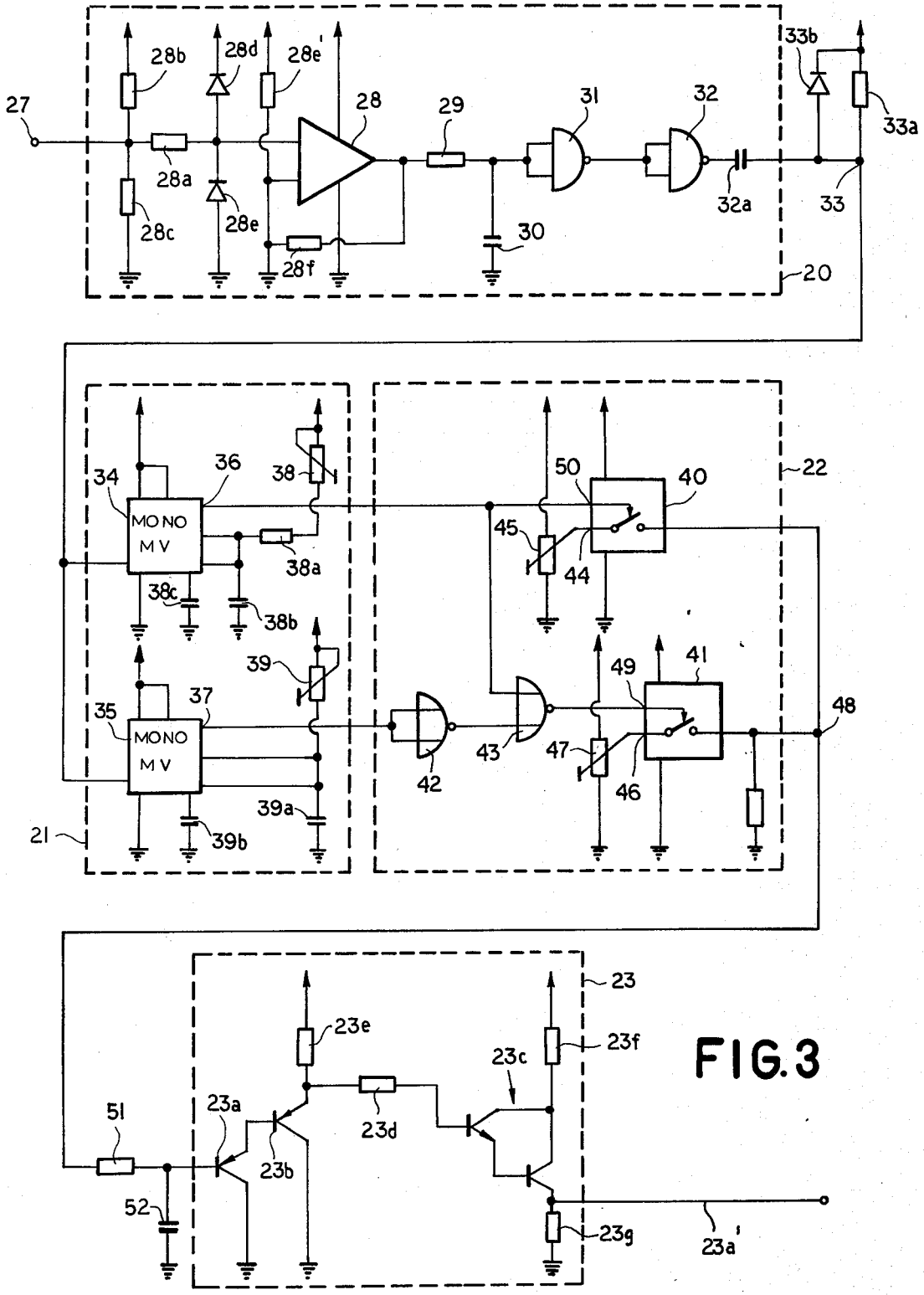
FIGS. 3 and 4 are circuit diagrams of the various stages shown in block form in FIG. 2.

FIG. 3 shows the stages 20, 22 and 23 in greater detail. In this circuit, the positive terminal of a direct current source or the voltage reference point, is represented in each case by an upwardly directed arrow, the negative terminal being a ground potential. Naturally, in practice, a positive bus will be provided in addition to the ground for the reference voltage or positive potential.

The input from the inductive proximity switch 19, which can be of conventional design, is applied by line 19*a* to the input terminal 27 of the pulse-forming stage 20 which thus receives the signal in the form of a voltage jump. This signal is applied through a resistor 28*a* to the input of operational amplifier 28 forming a threshold switch.

As is conventional when the operational amplifier is to be triggered into an output upon receipt of a voltage signal exceeding a predetermined level, the signal may be applied through a voltage divider network of resistors 28*b*, 28*c*, connected across the source, to a junction between a pair of series connected diodes 28*d*, 28*e* while the reference potential of the operation amplifier 28 is applied through a resistor 28*e* connected to the positive source potential and to another terminal of the operational amplifier 28. The latter is provided with the usual feedback resistor 28*f*.

The output pulse of the operational amplifier 28, inverted as is usually the case, is applied through time constant network 29, 30 to two Schmitt-trigger stages 31, 32 in tandem. Such Schmitt-trigger stages may be of the type described at pages 389 through 402 of Millman and Taub: *Pulse, Digital and Switching Waveforms*, McGraw-Hill Book Company, New York, 1965. The operational amplifier and its operation in the circuit shown will be apparent from Tobey, Graeme, Huelsman: *Operational Amplifiers*, McGraw-Hill Book Company, New York, 1971.

More specifically, the output of the operational amplifier 28 is applied to the resistor 29 and across the condenser 30 to the Schmitt-trigger 31, the RC circuit 29/30 serving to exclude short-duration noise signals or spikes. The rising flanks of the voltage pulses generated across the capacitor 30 are transformed into voltage pulses of greater steepness by the Schmitt-triggers 31 and 32.

The output of the second Schmitt-trigger 32 is applied via a blocking capacitor 32*a* to a junction 33 with a resistor 33*a* and a diode 33*b* tied to the positive terminal of the direct current source.

The signal developed at point 33 thus has a steep rising flank and a relatively slow drop.

This signal triggers two monostable multivibrator circuits 34 and 35 at the input to the timing stage 21. The monostable multivibrators are provided with time-constant networks including trim potentiometers 38, 39 for setting the respective pulse durations, the trim potentiometer 38 being in circuit with a resistor 38*a* and a capacitor 38*b* while the trim potentiometer 39 is in series with a condenser 39*a* across the direct current source. Condensers 38*c* and 39*b* are also provided in conventional monostable multivibrator configuration (see *Pulse, Digital and Switching Waveforms,* op.cit., pages 413 through 437).

At the output 36 of the monostable multivibrator 34 a relatively short-term rectangular voltage pulse is developed while at the output 37 of the monostable multivibrator 35, a comparatively longer-duration rectangular voltage pulse of the same magnetic appears. The pulse durations are set by the trim potentiometers 38 and 39.

The rectangular pulses are applied to two analog switches 40 and 41, the latter being in circuit with two NOR gates 42 and 43 forming part of a logic circuit such that the output pulse of the monostable multivibrator 35 is not applied to the control input 49 or the analog switch 41 as long as the output pulse from the monostable multivibrator 35 appears at the control input 50 of the analog switch 40. During this relatively brief interval, the analog switch 40 generates an output at 48 representing a voltage applied by the voltage-divider potentiometer to the input 44 of the switch 40. During this period, moreover, the voltage tapped from the potentiometer 47 (acting as a voltage divider) and applied at the input 46 of the analog switch 41 is not delivered to the point 48.

The potentiometers 45 and 47 thus function as adjustable voltage sources in voltage-divider form connected between the positive and negative terminals of the direct current source.

As soon as the output pulse from the monostable multivibrator 35 fails, the NOR gate 43 passes the output pulse of monostable multivibrator 35 which connects the input 46 to the output side of the controlled switch 41 so that the voltage tapped from potentiometer 47 is applied at the point 48. Switch 40 meanwhile has opened.

The voltage signal appearing at point 48 is thus in the form of a voltage pulse having a leading relatively high level and a following relatively low level, e.g. a pulse corresponding to a step function as shown in FIG. 2 with both steps being of rectangular wave form.

An RC network formed by an ohmic resistor 51 and a condenser 52 connected to the point 48 obliterates any spikes or hiatus between the two rectangular pulses which constitute the step function. The amplifier stage 23 serves to amplify the voltage pulses derived at the output side of this RC network. The amplifier shown in FIG. 3 may be of any conventional type. For example, as shown in the drawing, the first stage may be a Darlington pair of transistors 23*a*, 23*b* from which the signal is delivered to the second stage 23*c* by a coupling resistor 23*d*, resistors 23*e*, 23*f* and 23*g* being provided for the respective biasing voltages.

The output is tapped from the emitter circuit in FIG. 3 and is applied to the converter 24 via the line 23*a*.

Figure 4:
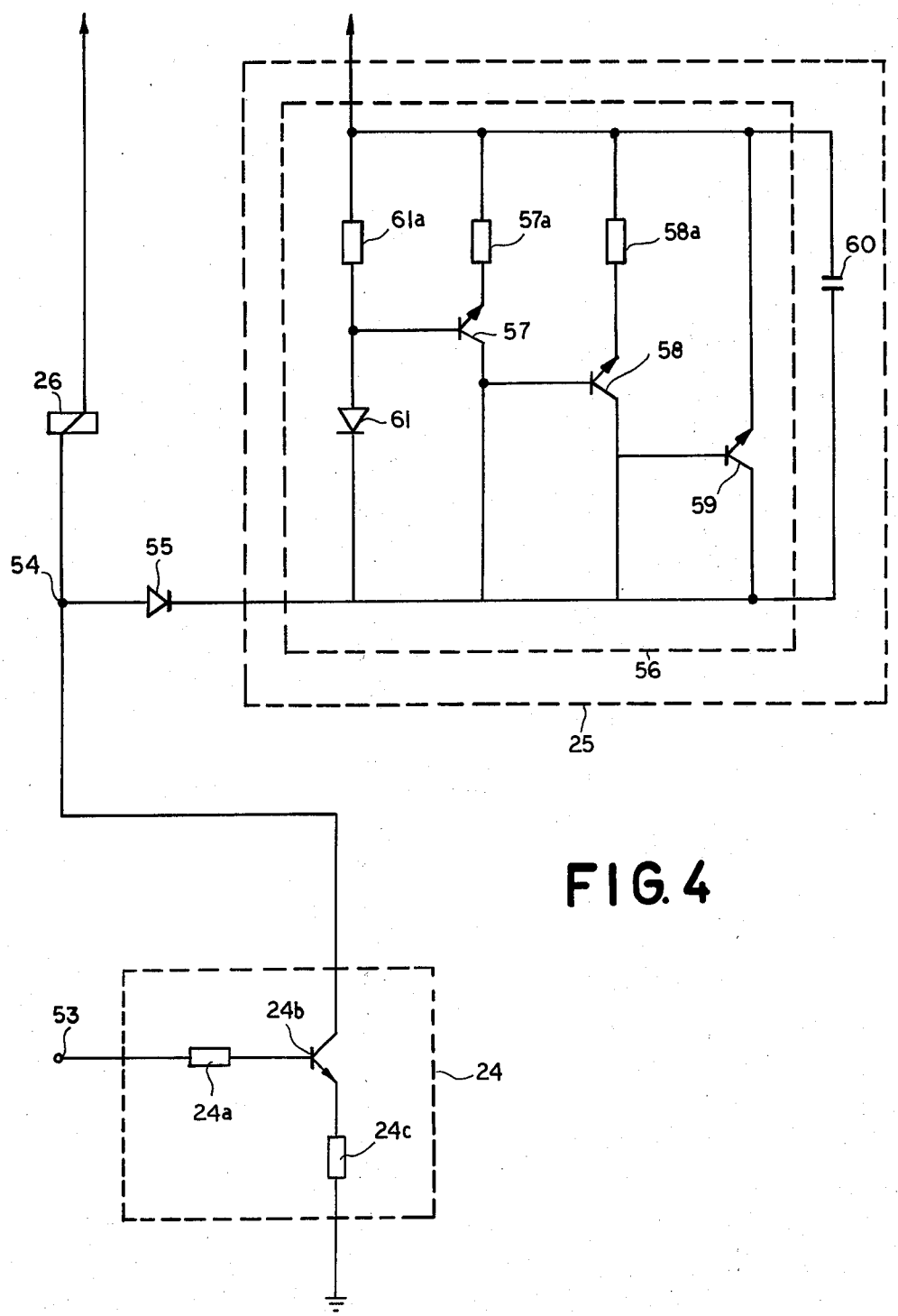

FIG. 4 shows the converter stage 24 in somewhat greater detail, this stage serving to transform the voltage pulse applied at its input 53, and communicated via the resistor 24*a* to the base of a transistor 24*b*, into a current pulse. To this end, the emitter-collector path of transistor 24*b* is connected in series with the current limiting resistor 24*c* and the coil 26 (corresponding to coil 11) between the positive terminal of the direct current source and ground.

Consequently, when the voltage pulse applied at 53 unblocks the transistor 24*b*, the current is drawn through the coil 26 to operate the magnet 11 and drive the armature 10 into the position shown in FIG. 1 to open the passage 6.

A diode 55, poled in the blocking direction, is connected to the junction 54 forming the input to the solenoid stage 26 and separates the intercepting stage 25 from the converter stage 24 and from the coil 26 in normal cases. However, when there is a failure of current through the junction 54 the resulting voltage spike of reference polarity at this point briefly passes the diode 55 and the voltage spike is detected to drain the energy stored in the coil 26 for the shortest possible opening times for the valve. This energy is shunted through the transistors 57, 58 and 59 which have their emitter collector networks connected in shunt directly with the coil or in series with resistors 57*a*, 58*a*. The transistor cascade 57, 58, 59 detects the reference voltage spike passed by the diode 55 through a detector network in the form of a zener diode 61 in series with a resistor 61*a* to the positive terminal, the base of the first transistor 57 of the cascade being tied to the junction between the resistor 61*a* and the zener diode 61. A portion of the energy passed by the diode 55 is taken up by the capacitor 60. The zener diode 61 and the transistor cascade 57,58,59 form the power zener diode 56.

The term "spike" is used here to refer to a distortion of relatively short duration superimposed on an otherwise regular or desired pulse waveform.

Thus, as has been described above, once the inductive proximity switch 19 is energized to effect switchover, e.g. in a cadence as described for the valve system of German Pat. No. 1,217,982, the resulting signal is transformed through the networks 20 to 22 to provide a stepped voltage pulse which is transformed into a rapid and sharp current pulse to accelerate the armature 10 followed by a lower level flow to maintain the valve opened. When the current pulse terminates, the energy of the coil is rapidly dissipated, as has been described, to allow rapid opening by the spring.

The inductive switch 19 can be of the type described at pages 30 ff. of *Transistor, Thyristor and Diode Manual,* Radio Corporation of America, Harrison, N.J. 1969.

Figure 5:
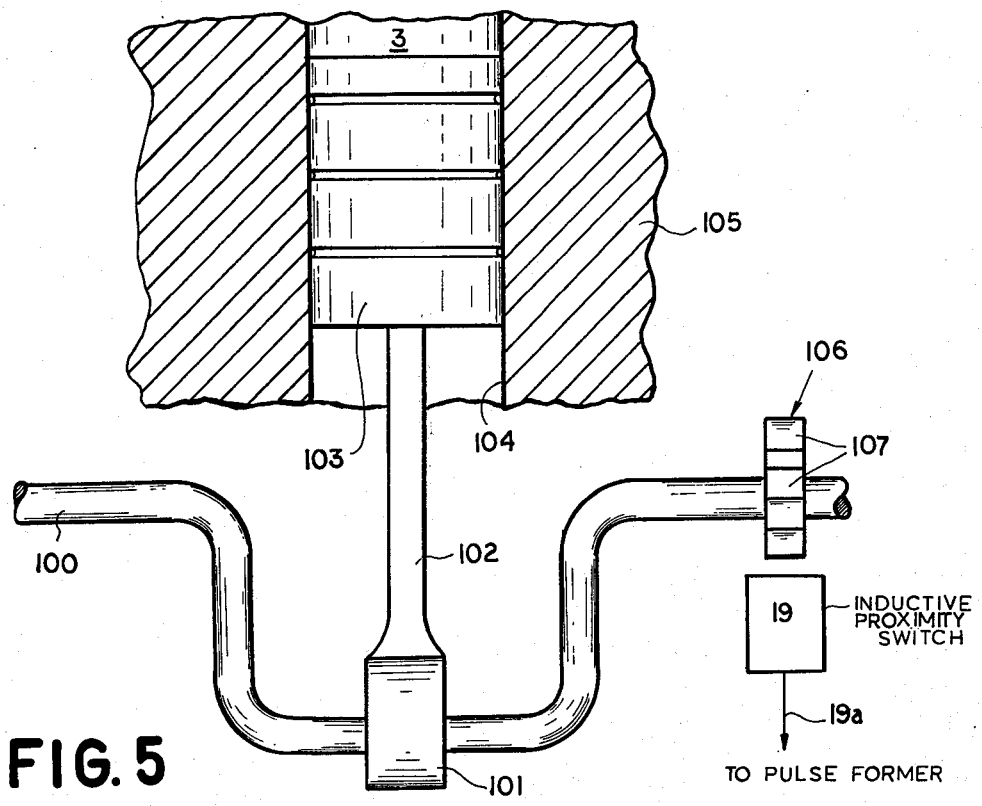
FIG. 5 is a cross-sectional view in diagrammatic form illustrating the operation of the inductive proximity switch of the invention.

As can be seen from FIG. 5, the proximity switch 19 can be constituted by lobes 107 of magnetic material on a timing disk 106 connected to the crankshaft 100 of the piston-type expansion machine which can function, in cryogenic processes, in the manner described at chapter 12, pages 29 ff. of Perry's *Chemical Engineer's Handbook*, op. cit.

In such systems, the crankshaft is coupled by a rod bearing 101 to a piston rod 102 which is articulated to the piston 103 which is driven by gas expansion in chamber 3 within the cylinder 104 of a cylinder block 105 which can carry the manifolds or be provided with a head in which valves of the type shown in FIG. 1 are mounted. The machine is, of course, used for the work expansion of gases from a high pressure state to a low pressure or ambient pressure condition.

We claim:

1. A valve system for a piston-type machine having a crankshaft connected to a piston reciprocable in a cylinder, said valve system comprising:

(a) a valve comprising:

a valve housing formed with a passage communicating between a pair of gas spaces and controlling gas flow relative to said cylinder, a valve member shiftable in said passage between an open and a closed position, an armature connected to said valve member and axially displaceable in said housing for shifting said valve member from one of said positions to another of said positions, a spring operatively connected to said valve member for biasing said valve member and said armature in one direction toward one of said positions, a pole piece surrounding said armature and defining a pair of axially-spaced magnetic poles cooperating with said armature, each of said poles having a recess conforming to the cross section of said armature and receiving same with limited radial play, and a coil in said housing energizable to generate a magnetic field through said pole piece and displace said armature relative thereto;

(b) an inductive proximity switch responsive to operation of said crankshaft for producing a timing signal for said valve; and (c) circuit means connected between said inductive proximity switch and said coil for energizing same, said circuit means comprising:

an input pulse forming stage connected to said switch for generating a steep-flank voltage pulse upon receipt of said signal, a timer stage connected to said input stage for producing two rectangular voltage pulses of different adjustable duration upon receipt of said steep-flank pulse, a gating stage connected to said timer stage and responsive to said rectangular pulses for producing a stepped voltage signal having a high amplitude initial portion and a low amplitude following portion, an amplifier stage connected to said gating stage for amplifying said stepped signal, a power converter stage connected to said amplifier stage for energizing said coil with a current pulse of stepped amplitude conforming to the amplified stepped signal, and an intercept stage effective upon current deenergization of the coil for draining same to enable rapid displacement of said valve member by said spring.

2. The system defined in claim 1 wherein the depth of the recess of the pole out of which the armature moves upon energization of said coil is greater than the depth of the recess of the other pole and the bottom of the recess of said other pole is provided with at least one nonmagnetic spacer element defining a small axial air gap between said bottom and the armature in the energized condition of said coil.

3. The system defined in claim 2 wherein said crankshaft is provided with a metal formation cooperating with said inductive switch.

4. The system defined in claim 2 or claim 3 wherein said pulse forming stage comprises in succession, a threshold-type operational amplifier circuit and two Schmitt-trigger stages to produce the steep-flank pulse.

5. The system defined in claim 2 wherein the timer stage comprises a pair of monostable multivibrators, each having an externally operable trim resistor for controlling the duration of the respective rectangular pulse generated thereby.

6. The system defined in claim 5 wherein said gating stage comprises a pair of analog switches each provided with a respective voltage source and triggerable to connect the respective voltage source to said amplifier, one of said monostable multivibrators being connected to a control input of one of said analog switches and to one input of a NOR gate, the other of said monostable multivibrators being connected through another NOR gate to another input of the first-mentioned NOR gate, said first NOR gate being connected to the control input of the other analog switch.

7. The system defined in claim 2 or claim 6 wherein said intercept comprises a diode connected between said coil and a terminal of a current supply source in series with a capacitor, a zener diode resistor network being connected across said capacitor to detect deenergization of said coil.

8. The system defined in claim 7 wherein said monitoring stage further comprises a transistor cascade having emitter-collector networks connected across said capacitor and switched through said zener diode-resistor network.

* * * * *